US008239118B2

(12) United States Patent
Dintino et al.

(10) Patent No.: US 8,239,118 B2
(45) Date of Patent: Aug. 7, 2012

(54) METHOD AND SYSTEM FOR CONTROLLING A HIGH PRESSURE PUMP, PARTICULARLY FOR A DIESEL ENGINE FUEL INJECTION SYSTEM

(75) Inventors: Maura Dintino, Turin (IT); Paolo Zamboni, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 690 days.

(21) Appl. No.: 12/471,960

(22) Filed: May 26, 2009

(65) Prior Publication Data

US 2009/0299606 A1 Dec. 3, 2009

(30) Foreign Application Priority Data

May 28, 2008 (EP) ..... 08009662

(51) Int. Cl.
*F02D 41/30* (2006.01)
*F02M 57/02* (2006.01)

(52) U.S. Cl. ..... 701/103; 123/446

(58) Field of Classification Search ..... 701/103–105, 701/102, 114, 115; 123/446, 447, 457, 458, 123/494, 480
See application file for complete search history.

(56) References Cited

U.S. PATENT DOCUMENTS

| | | | | |
|---|---|---|---|---|
| 5,609,140 | A | 3/1997 | Kramer et al. | |
| 6,497,223 | B1 | 12/2002 | Tuken et al. | |
| 6,814,058 | B2 * | 11/2004 | Oono | 123/458 |
| 7,543,566 | B2 * | 6/2009 | Holl et al. | 123/446 |
| 2003/0046330 | A1 | 3/2003 | Hayes | |

FOREIGN PATENT DOCUMENTS

| | | | |
|---|---|---|---|
| DE | 102005042140 | A1 | 4/2006 |
| DE | 102006018648 | A1 | 5/2007 |
| EP | 1146218 | A2 | 10/2001 |
| EP | 1441119 | A2 | 7/2004 |
| FR | 2812345 | A1 | 2/2002 |

* cited by examiner

*Primary Examiner* — Hieu T Vo
(74) *Attorney, Agent, or Firm* — Ingrassia Fisher & Lorenz, P.C.

(57) ABSTRACT

In a fuel injection system of an internal combustion engine, including, but not limited to a high pressure pump adapted to deliver a fuel mass conveyed from a fuel tank to a high pressure region to which a plurality of injectors is connected, including a fuel metering device for adjusting the fuel quantity to be delivered to the high pressure region, a pressure sensor for measuring fuel pressure in the high pressure region; and an electronic control unit arranged for driving the fuel metering device through an energizing signal (Inom; Iact) as a function of the measured fuel pressure and the engine operating mode, where the electronic control unit is arranged for determining the energizing signal (Inom; Iact) for driving the fuel metering device according to a nominal characteristic curve (A) of the high pressure pump representative of a predetermined relationship between the energizing signal and the fuel mass delivered by the pump, the operating pressure is controlled by driving the fuel metering device with an energizing signal determined according to an updated characteristic curve (B) estimated by applying to the nominal characteristic curve (A) an offset between the actual energizing signal value (Iact) related to the controlled fuel mass delivered to the high pressure region in a predetermined engine operating point and a nominal energizing signal (Inom) related to the controlled fuel mass according to the nominal characteristic curve (A).

12 Claims, 2 Drawing Sheets

METHOD AND SYSTEM FOR CONTROLLING A HIGH PRESSURE PUMP, PARTICULARLY FOR A DIESEL ENGINE FUEL INJECTION SYSTEM

CROSS-REFERENCE TO RELATED APPLICATION

This application claims priority to European Patent Application No. 08009662.1, filed May 28, 2008, which is incorporated herein by reference in its entirety.

TECHNICAL FIELD

The present invention refers to fuel injection in internal combustion engines, and specifically to a method and system for controlling a high pressure pump in a fuel injection system, particularly for a diesel engine.

BACKGROUND

In a fuel injection system for a diesel engine, fuel under pressure is supplied directly to the injectors or to a common rail (generally referred to in the following description as a high pressure region) by means of a continuously operating high-pressure pump driven by the engine. The required pressure high injection pressure, which is variable dependent on the engine operating point, is controlled by a valve or metering device of the fuel mass located at the inlet of the high-pressure pump at the low-pressure side of the injection system. The valve or metering device makes sure that the pump delivers the right quantity of fuel to the injectors or the common rail according to the current fuel pressure measured by a sensor arranged at the high pressure side, by applying a closed loop control driven by an electronic control unit.

The metering device is traditionally built as a solenoid valve, and a plunger driven by solenoid force is adapted to free up a metering orifice on the suction side of the pump. Specifically, a fuel flow mass to be delivered by the pump is estimated by the control system dependent on the fuel pressure measured by the sensor as a function of the engine operating mode (e.g., the engine speed as well as other influencing parameters such as fuel and intake-air temperature) and the driver's wishes (e.g., accelerator-pedal setting).

A desired fuel flow mass is obtainable by driving the solenoid valve of the metering device with an actuating signal, specifically an energizing current, which may be determined according to the characteristic of the valve. A nominal characteristic curve of the valve representative of a predetermined relationship between an admissible range of values of an energizing current and the corresponding operating position of the valve (i.e., the fuel flow mass allowed by the metering device, is given by the manufacturer of said device).

In a high pressure system where the fuel pressure is regulated by a valve (metering device) at the inlet of the high pressure pump the electrical characteristics of the valve are fundamental in order to obtain good performances of the control. When the valve has a big production dispersion, the pump characteristic has a big deviation around the nominal characteristic that can cause undershoots and overshoots of the control system during transient conditions, as well as pressure deviations, both positive (i.e., the pressure set-point is higher than the actual pressure) or negative (i.e., the actual pressure is higher than the pressure set-point). These effects not only lead to emissions worsening and noise increasing, but also to the risk of high pressure pump damaging in case of pressure negative deviation.

At least one aim of the present invention is to overcome the drawbacks of the prior art by providing a control method and system for a high pressure pump, which take into account the deviation of the pump characteristic due to production dispersion or ageing. Specifically, it is at least one object of the present invention to develop a strategy for effectively controlling the operating high pressure in a cost-effective fuel injection system equipped with a metering device arranged for regulating the fuel pressure at the inlet of the high pressure system. In addition, other objects, desirable features, and characteristics will become apparent from the subsequent summary and detailed description, and the appended claims, taken in conjunction with the accompanying drawings and this background.

SUMMARY

In summary, an adaptive strategy is provided which estimates the characteristic deviation of a high pressure pump in a specific engine point in strict, reproducible conditions and corrects it as an offset in order to update the nominal characteristic of the pump fuel delivery. Advantageously, a faster and more effective control of the high pressure fuel delivery without losing in response performances of the whole system is performed.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding summary and background or the following detailed description.

Figure 1:
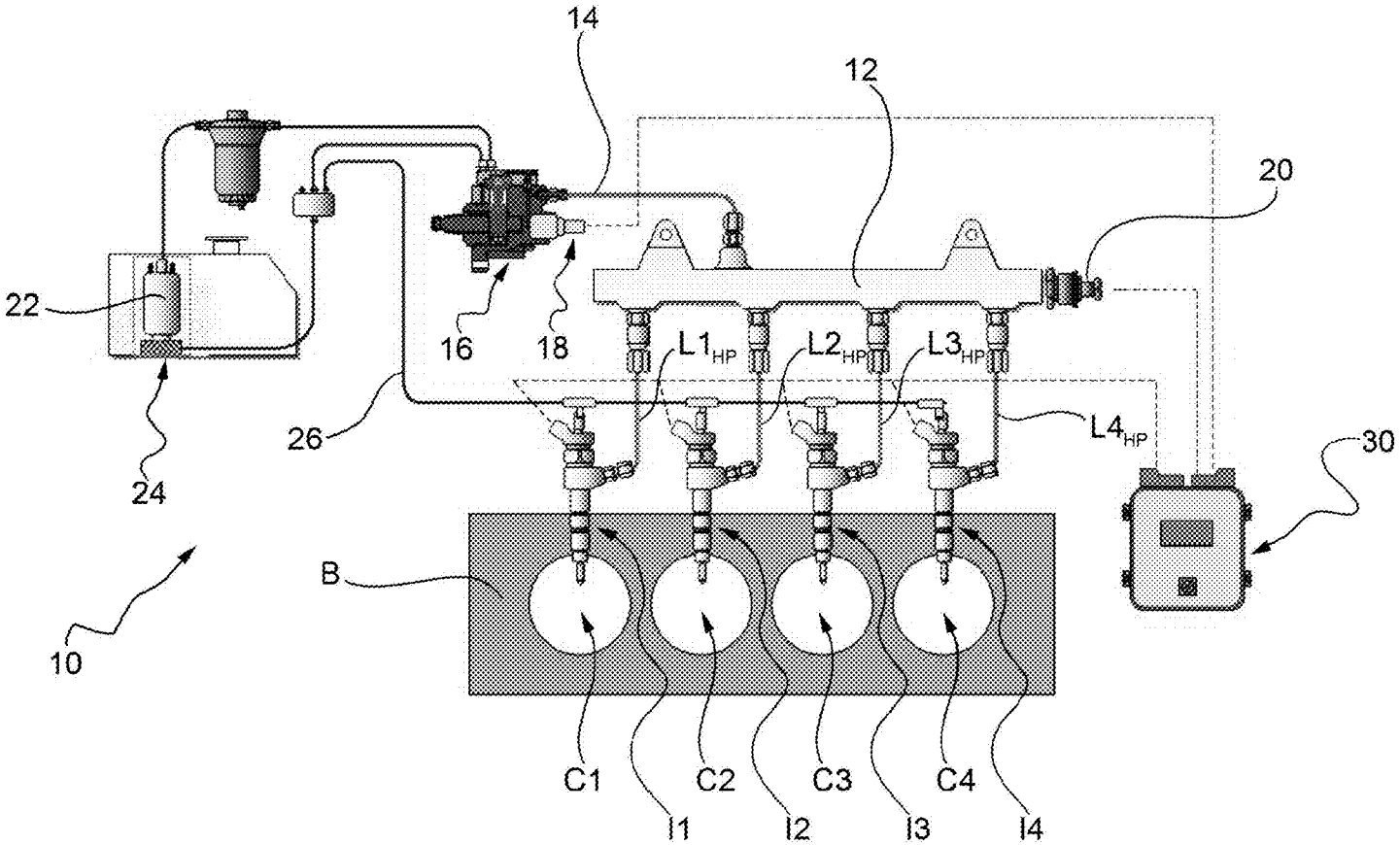
FIG. 1 shows a diagrammatic view of a fuel injection system in an internal combustion engine according to the invention.

In FIG. 1 of the annexed drawings, an internal combustion engine, such as a diesel engine, equipped with a common-rail fuel injection system (e.g., an engine adapted to be fitted in a motor-vehicle), is generally referred to with 10. The engine 10 is in particular a four-stroke engine, which in the exemplary embodiment shown has four cylinders made in an engine block B. Respective electrically-controlled fuel injectors, for instance solenoid-operated injectors I1-I4, are fitted in the cylinder heads, and each of them is adapted to deliver a predetermined amount of pressurized fuel to a combustion chamber of a respective cylinder C1-C4 of the engine.

In a per se known manner, the engine 10 comprises a common accumulator volume or fuel rail 12 connected by means of a high-pressure supply line 14 to a high-pressure pump 16 equipped with pressure regulating means such as a metering device 18, for supplying fuel under a predetermined target high pressure to the accumulator volume. A rail pressure sensor 20 is fitted to the fuel rail 12 and adapted to detect fuel pressure inside the rail and issue a corresponding pressure signal.

The metering device 18 is adapted to regulate the flow of fuel fed to the high-pressure pump 16 from a low-pressure pump 22 associated to a fuel tank 24 of the motor-vehicle (e.g., by returning excess fuel to the fuel tank, with a view to adjusting the fuel pressure in the accumulator volume as a function of the pressure measurement), so as to maintain a predetermined target injection pressure set-point dependent on the engine operating point. The metering device is built as an infinitely variable solenoid valve, and a plunger operated through an armature driven by solenoid force generated by a controllable energizing current is adapted to free up a metering orifice on the suction side of the pump.

The fuel injectors I1-I4 are commonly connected to the fuel rail 12 through respective short high-pressure lines L1HP-L4HP for conveying the pressurized fuel intended to be injected in the combustion chamber of the respective cylinder. The fuel injectors I1-I4 are also connected back to the fuel tank 24 through a re-circulating low-pressure line 26 for discharge of dynamic leakages which occur from the injector chamber at the time of energizing the solenoid actuating valve prior to the opening of the injector nozzle.

The fuel injectors I1-I4, as well as the metering device 18, are suitably driven by a electronic control unit 30 receiving information on the current fuel pressure in the accumulator volume through the rail pressure sensor 20 and storing a predetermined injection map interrelating the injection fuel quantity and pressure with the engine operating mode (the engine speed as well as other influencing parameters such as fuel and intake-air temperature) and the driver's wishes (accelerator-pedal setting).

The electronic control unit 30 is arranged for storing in addition a nominal characteristic operating curve of the metering device, which is representative of a predetermined relationship between an admissible range of values of an energizing current of the solenoid valve and the corresponding operating position of the valve (i.e., the fuel flow mass allowed by the metering device). During normal operating conditions, the rail pressure is maintained by the metering device 18 associated with the high-pressure pump 16 very close to a desired pressure set-point which is determined as a function of the engine operating point.

Figure 2:
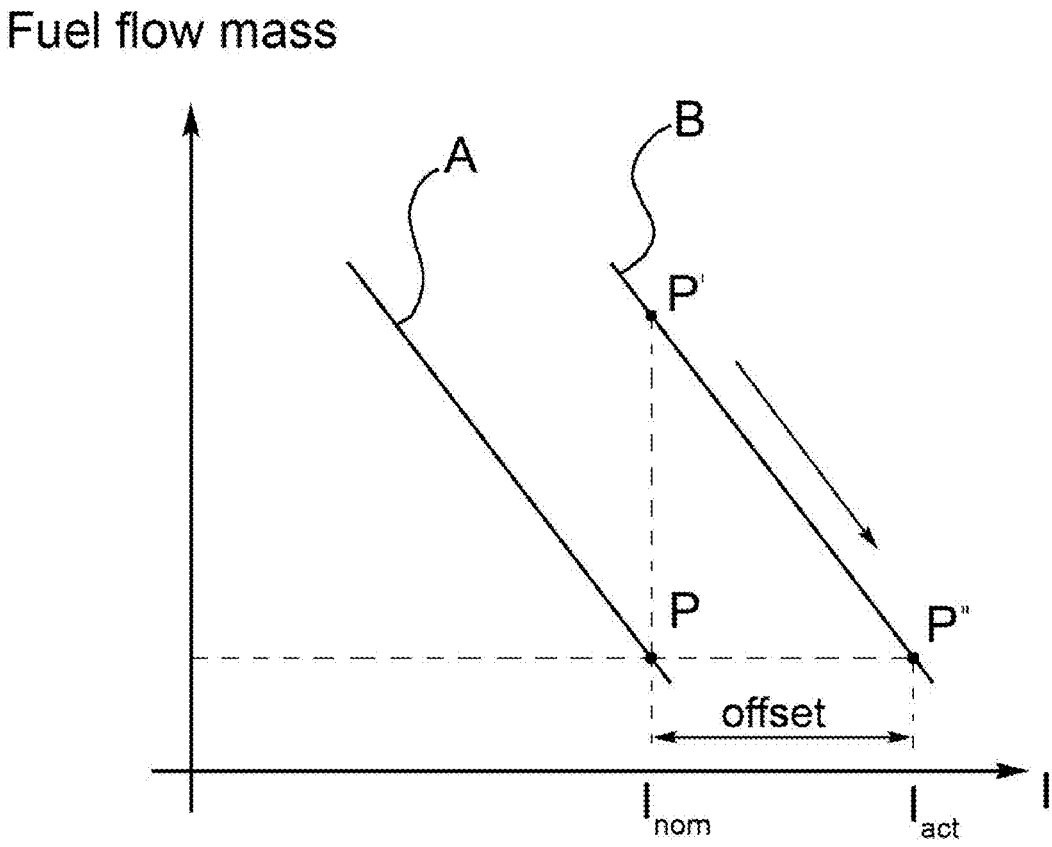
FIG. 2 is a graph showing a nominal and an actual characteristic curve of the high pressure pump of a fuel injection system of FIG. 1.

FIG. 2 is a graph depicting the operation of the method according to an embodiment of the invention when deviation from the nominal characteristic curve of the pump is detected. A nominal characteristic curve of the valve representative of a predetermined relationship between an admissible range of values of an energizing current actuating the metering device and the corresponding fuel flow mass allowed by the metering device due to operating position of the valve is indicated with A. Conveniently, the characteristic curve is considered to be a straight line and it is assumed that drifts due to sensor ageing or manufacturing tolerances do not modify the linearity of the relationship. The actual pump characteristic is a function of the energizing current that circulates into the valve and the fuel flow delivered from the pump correspondent to that current, and is indicated with B. The pump dispersion can be considered as a negative or positive offset of current around the nominal curve.

According to the control strategy, the current offset is estimated in a precise engine operating point, which is chosen in order to have high probability to perform the strategy during the vehicle cycle, in terms of occurrence during the cycle and permanence in steady-state. The precise engine operating point is chosen to be the engine idle state at still vehicle, which is stationary, reproducible and independent of the driving attitude. The fuel flow to the engine is nevertheless dependent on other operating and physical parameters and therefore, in order to reproduce the same conditions for an accurate estimation, the operating point is detected according to predetermined strict constraint values of at least one of an engine speed, a fuel pressure, a fuel pressure error, a fuel quantity injected, an engine temperature, and a fuel temperature.

After the idle state has been identified, the operating and physical parameters are verified to be constant for a predetermined time (preferably, time duration in the order of seconds). Once the engine operating point has been fully recognized, the high pressure control strategy calculates a target mean value for the fuel flow, which takes into account any cumulative ripple on those parameters. In view of the target fuel flow mass and according to the nominal characteristic curve currently stored in the electronic control unit, the control strategy of the pump estimates and drives a nominal energizing current Inom for actuating the metering device.

With reference to FIG. 2, it could be appreciated that when the metering device actually operates according to a characteristic curve B different from the nominal one, applying the energizing current Inom leads the device to operate at point P' on the actual characteristic curve B, instead of point P on the nominal curve A. In this condition the pressure closed-loop control of the pump has to correct the overshoot in a longer transient time than if it were based on the correct characteristic curve. The work of the closed-loop control aims at reaching the correct target pressure (i.e., fuel flow mass) moving the operating point on the actual characteristic curve along the arrow as depicted in the figure, until the target fuel mass flow is reached at point P". When the target operating point P" has been reached a corresponding energizing current Iact is detected and the difference between the actual energizing current applied by the pressure control to keep the desired pressure and the nominal energizing current is determined as the offset mean value of the pump characteristic.

Calibration of the pump characteristic curve is preferably made a first time after installing the injection system, and then at predetermined times during the life cycle of the pump. Conveniently, an updated characteristic curve of the pump is applied by the control system in a driving condition at a time in which the driver cannot notice it (e.g., when releasing the accelerator pedal), or at a new starting of the engine.

Advantageously, the main benefits of the calibration system according to an embodiment of the invention are a greater component durability and, as consequence, maintenance cost reduction, as well as quality improvements in emissions and noise of the engine. Where the principle of the invention remains the same, the embodiments and the details thereof can be varied considerably from what has been described and illustrated purely by way of non-limiting example, without departing from the scope of protection of the present invention as defined by the attached claims.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A fuel injection system of an internal combustion engine, comprising:

a high pressure pump adapted to deliver a fuel mass conveyed from a fuel tank to a high pressure region coupled to a plurality of injectors;

a fuel meter adapted to adjust a fuel quantity to be delivered to the high pressure region;

a sensor adapted to measure a fuel pressure in the high pressure region; and an electronic control unit arranged for:

driving the fuel meter through an energizing signal as a function of a measured fuel pressure and an engine operating mode, determining the energizing signal according to a nominal characteristic curve (A) of the high pressure pump representative of a predetermined relationship between the energizing signal and the fuel mass delivered by the high pressure pump;

acquiring an actual energizing signal value related to the fuel mass delivered to the high pressure region in a predetermined engine operating point;

determining an offset between an actual energizing signal and a nominal energizing signal related to the fuel mass according to the nominal characteristic curve (A);

estimating an updated characteristic curve (B) by applying said offset to the nominal characteristic curve (A); and applying said updated characteristic curve (B) for determining the energizing signal for driving said fuel meter.

2. The fuel injection system according to claim 1, wherein said predetermined engine operating point is an engine idle state.

3. The fuel injection system according to claim 2, wherein said engine idle state is associated with values of at least one an engine speed, the fuel pressure, a fuel pressure error, a injected fuel quantity, an engine temperature, and a fuel temperature.

4. A fuel injection system according to claim 3, wherein said electronic control unit is further arranged for detecting parameters when they are maintained constant for a predetermined time.

5. The fuel injection system according to claim 1, wherein said electronic control unit is further arranged for estimating the updated characteristic curve (B) periodically according to predetermined learning rate.

6. The fuel injection system according to claim 1, wherein said electronic control unit is further arranged for estimating the updated characteristic curve (B) by applying an offset mean value to the nominal characteristic curve (A), the offset mean value being calculated by filtering a plurality of offset values due a ripple on a target fuel flow mass value.

7. A method for controlling a fuel injection system of an internal combustion engine, comprising the steps of:

determining an energizing signal for driving a fuel meter according to a nominal characteristic curve (A) of a high pressure pump representative of a predetermined relationship between the energizing signal and a fuel mass delivered by the high pressure pump;

acquiring an actual energizing signal value (Iact) related to the fuel mass delivered to a high pressure region in a predetermined engine operating point;

determining an offset between said actual energizing signal value (Iact) and a nominal energizing signal (Inom) related to said fuel mass according to the nominal characteristic curve (A);

estimating an updated characteristic curve (B) by applying said offset to the nominal characteristic curve (A); and applying said updated characteristic curve (B) for determining the energizing signal for driving said fuel meter;

acquiring the actual energizing signal value (Iact) related to the fuel mass delivered to the high pressure region in the predetermined engine operating point;

determining an offset between said actual energizing signal value (Iact) and the nominal energizing signal (Inom) related to said fuel mass according to the nominal characteristic curve (A);

estimating said updated characteristic curve (B) by applying said offset to the nominal characteristic curve (A); and applying said updated characteristic curve (B) for determining the energizing signal for driving said fuel meter.

8. The method according to claim 7, wherein said predetermined engine operating point is an engine idle state.

9. The method according to claim 8, wherein said engine idle state is associated with values of at least one an engine speed, a fuel pressure, a fuel pressure error, a fuel quantity injected, an engine temperature, and a fuel temperature.

10. A method according to claim 9, further comprising the step of detecting parameters when they are maintained constant for a predetermined time.

11. The method according to claim 7, further comprising the steps of estimating said updated characteristic curve (B) periodically according to predetermined learning rate.

12. The method according to claim 7, further comprising the step of estimating said updated characteristic curve (B) by applying an offset mean value to the nominal characteristic curve (A), the offset mean value being calculated by filtering a plurality of offset values due a ripple on a target fuel flow mass value.

* * * * *